US010714855B2

(12) United States Patent
Tu

(10) Patent No.: US 10,714,855 B2
(45) Date of Patent: Jul. 14, 2020

(54) ELECTRICAL CONNECTOR

(71) Applicant: LOTES CO., LTD, Keelung (TW)

(72) Inventor: Yang Yang Tu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/446,832

(22) Filed: Jun. 20, 2019

(65) Prior Publication Data

US 2020/0021050 A1 Jan. 16, 2020

(30) Foreign Application Priority Data

Jul. 10, 2018 (CN) ..... 2018 1 0748814

(51) Int. Cl.
*H01R 13/11* (2006.01)
*H01R 13/41* (2006.01)
*H01R 13/631* (2006.01)

(52) U.S. Cl.
CPC ..... *H01R 13/111* (2013.01); *H01R 13/41* (2013.01); *H01R 13/631* (2013.01)

(58) Field of Classification Search
CPC ..... H01R 13/111; H01R 13/41; H01R 13/631
See application file for complete search history.

(56) References Cited

U.S. PATENT DOCUMENTS 7,828,578 B1 * 11/2010 Ju ..... H01R 13/193 439/342
8,016,623 B2 * 9/2011 Ju ..... H01R 13/112 439/342
8,047,864 B1 * 11/2011 Ju ..... H01R 4/58 439/342
2011/0189898 A1 * 8/2011 Ju ..... H01R 24/00 439/660
2012/0156939 A1 * 6/2012 Ju ..... H01R 12/7082 439/660
2012/0252274 A1 * 10/2012 Ju ..... H01R 12/716 439/626
2019/0372255 A1 * 12/2019 Huang ..... H01R 12/716

FOREIGN PATENT DOCUMENTS

CN 2293128 Y 9/1998
CN 100546114 C 9/2009
CN 201570752 U * 9/2010
CN 201570752 U 9/2010

* cited by examiner

*Primary Examiner* — Abdullah A Riyami
*Assistant Examiner* — Nader J Alhawamdeh
(74) *Attorney, Agent, or Firm* — Locke Lord LLP; Tim Tingkang Xia, Esq.

(57) ABSTRACT

An electrical connector is used to be electrically connected to a chip module having multiple pins. The electrical connector includes a body to support the chip module upward and provided with multiple accommodating holes penetrating through an upper surface and a lower surface of the body, and multiple terminals correspondingly accommodated in the accommodating holes. Each accommodating hole has a blocking wall. Each terminal includes a base, two first arms bending forward from two opposite sides of the base and extending upward, and a second arm bending forwards from the base and extending downward. The two first arms have two clamping portions and two first guiding portions extending upward from the two clamping portions and away from each other. The blocking wall covers upper ends of the two first guiding portions. The second arm has a second guiding portion and an abutting portion extending downward from the second guiding portion.

10 Claims, 13 Drawing Sheets

A-A

D-D

E-E

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810748814.1 filed in China on Jul. 10, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector electrically connected to a chip module.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector is configured to be electrically connected to a chip module provided with multiple pins. The electrical connector includes an insulating body, a plurality of terminal slots penetrating vertically through the insulating body, and a plurality of conductive terminals accommodated in the terminal slots.

Each conductive terminal includes a main body and three elastic arms formed by extending upward from the main body. Each elastic arm includes a guiding portion formed by extending downward from a top end thereof and a contact portion formed by extending downward from the guiding portion, and the top end of the elastic arm is exposed in an opening at an upper end of a corresponding terminal slot.

When the electrical connector is used, the pins of the chip module are inserted downward into the terminal slots, the guiding portions guide the pins to move downward, and each pin is clamped among the three elastic arms of the corresponding conductive terminal, to facilitate electrical connection between the chip module and the electrical connector.

However, when the pins of the chip module are deviated relatively to normal insertion positions when being inserted downward, the pins of the chip module may easily move downward to collide with the top ends of the elastic arms, resulting in the elastic arms being damaged due to the collision, and thereby affecting stable conduction between the chip module and the electrical connector.

Therefore, a heretofore unaddressed need to design a new electrical connector exists in the art to address the aforementioned deficiencies and inadequacies.

SUMMARY

The present invention is directed to provide an electrical connector that prevents the terminals from being damaged and enables pins of a chip module to be inserted successfully.

To achieve the foregoing objective, the present invention adopts the following technical solutions:

An electrical connector is configured to be electrically connected to a chip module having a plurality of pins. The electrical connector includes: a body, configured to support the chip module upward, wherein the body is provided with a plurality of accommodating holes penetrating through an upper surface and a lower surface of the body, and each of the accommodating holes has a blocking wall; and a plurality of terminals, correspondingly accommodated in the accommodating holes, wherein each of the terminals comprises a base, two first arms bending forward from two opposite sides of the base and extending upward, and a second arm bending forward from the base and extending downward, the two first arms have two clamping portions and two first guiding portions extending upward from the two clamping portions and away from each other, the blocking wall of a corresponding accommodating hole covers upper ends of the two first guiding portions, the second arm has a second guiding portion and an abutting portion extending downward from the second guiding portion, the two first guiding portions and the second guiding portion are configured to guide a corresponding pin of the pins to insert downward, and the two clamping portions and the abutting portion are configured to clamp the corresponding pin altogether.

In certain embodiments, a gap between the two clamping portions increases gradually in a backward direction from front thereof.

In certain embodiments, an upper end of each of the two first arms is concavely provided with an opening connected to a front side of a corresponding one of the two first guiding portions.

In certain embodiments, a width of the opening is less than a diameter of a lower end of the corresponding pin.

In certain embodiments, each of the accommodating holes comprises a guiding hole downward concavely provided on the upper surface of the body, a connecting hole extending downward from the guiding hole and configured to accommodate the corresponding pin, and an receiving hole extending downward from the connecting hole to penetrate through the lower surface of the body and configured to accommodate a corresponding terminal of the terminals, a hole size of the connecting hole is less than a hole size of the receiving hole, an upper wall of the receiving hole forms the blocking wall, and the two clamping portions and the abutting portion of the corresponding terminal are all located right below the connecting hole.

In certain embodiments, a height of a contact position of each of the clamping portions and the corresponding pin is different from a height of a contact position of the abutting portion and the corresponding pin.

In certain embodiments, the contact position of each of the clamping portions and the corresponding pin is higher than the contact position of the abutting portion and the corresponding pin.

In certain embodiments, the base has a through hole and two hook portions located at two opposite sides of the through hole, the second arm is formed by extending downward from an upper end of the through hole, the body is provided with two position limiting slots corresponding to the two hook portions, the position limiting slots penetrate upward through the upper surface of the body, and a bottom surface of each of the position limiting slots is located right below a corresponding hook portion of the hook portions to limit the corresponding terminal from moving downward.

In certain embodiments, two protruding portions are formed by extending from a left side and a right side of the base in a left-right direction and then extending upward, and the two protruding portions match with the corresponding accommodating hole to limit the terminal from moving.

In certain embodiments, a side edge of one of the two protruding portions is provided with a protrusion in interference-fit with the corresponding accommodating hole, and a side edge of the other of the two protruding portions is a straight line.

Compared with the related art, the electrical connector according to certain embodiments of the present invention have the following beneficial effects:

When the corresponding pin is deviated relatively to a normal insertion position when being inserted downward, since the blocking wall covers the upper ends of the two first guiding portions and the second arm is formed by extending downwards from the base, the corresponding pin will not collide with the free ends of the two first arms and the free end of the second arm, thereby preventing the two first arms and the second arm from being damaged and facilitating the corresponding pin to be inserted successfully, and ensuring stable conductive connection between the chip module and the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
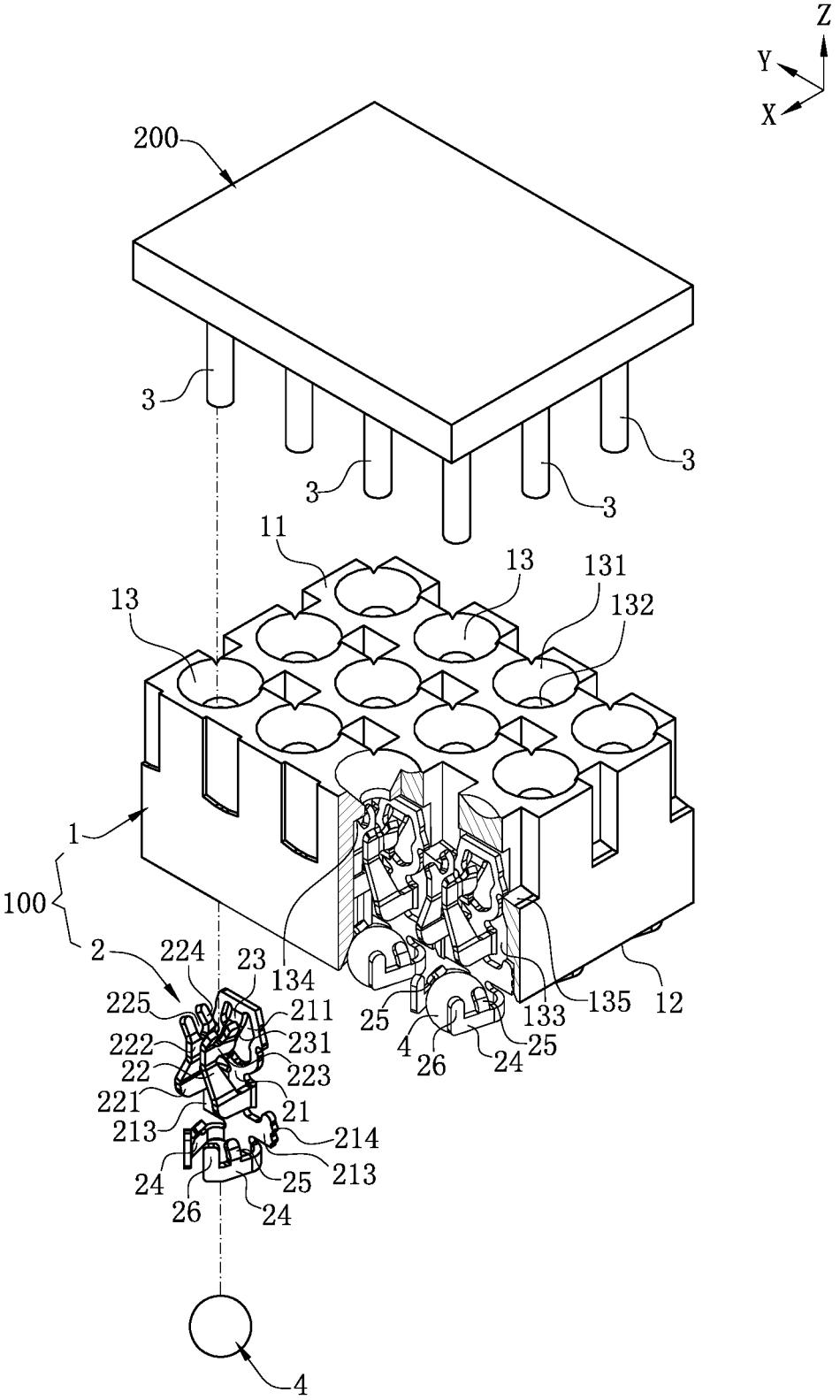
FIG. 1 is a perspective view of an electrical connector according to certain embodiments of the present invention before being assembled to a chip module.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector.

As shown in FIG. 1, in an electrical connector 100 according to certain embodiments of the present invention, a front-rear direction X as well as a left-right direction Y and a vertical direction Z that are perpendicular to the front-rear direction X are defined.

Figure 7:
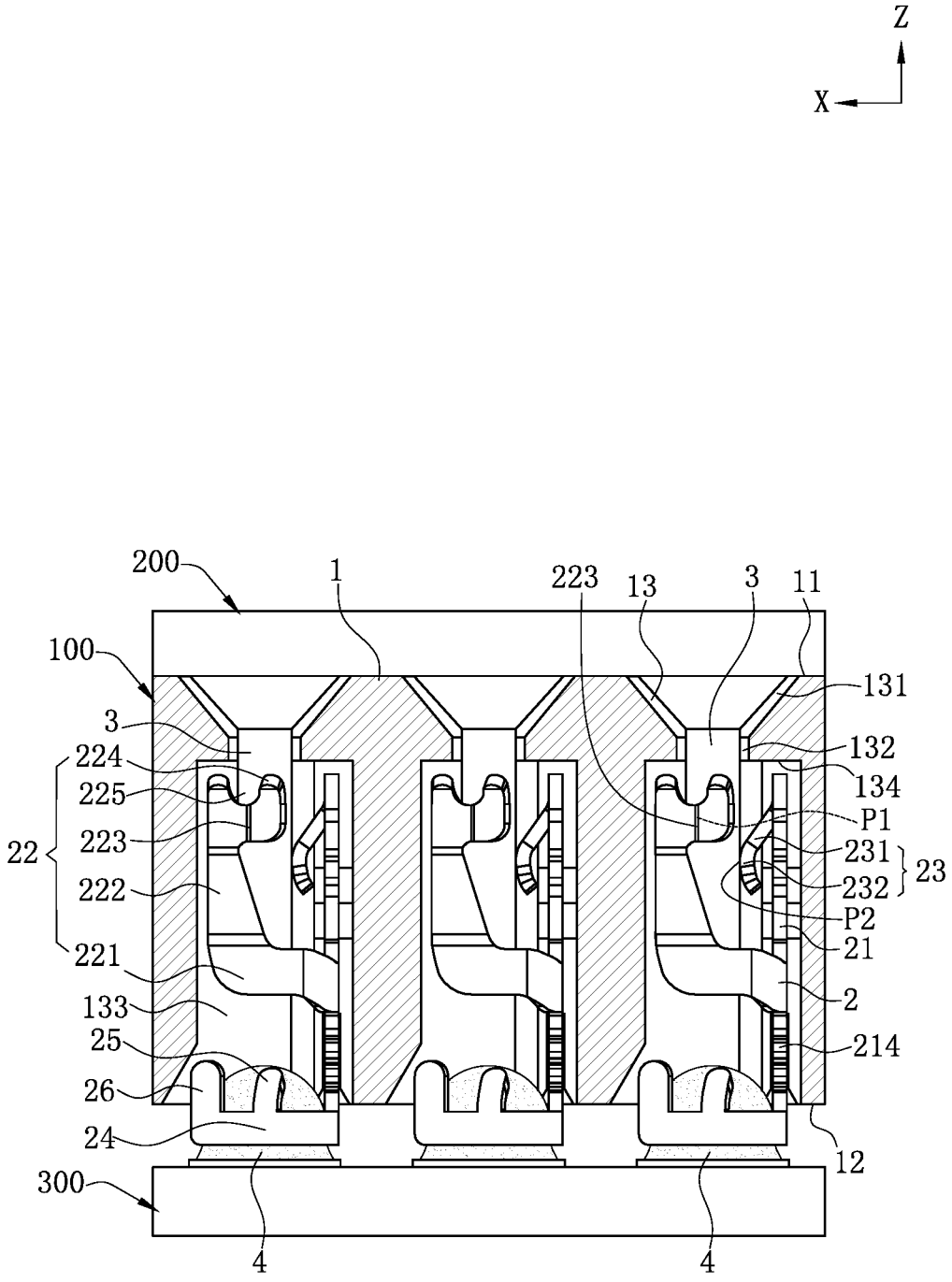
FIG. 7 is a cross-sectional view of the electrical connector and the chip module in FIG. 6 after being assembled.

As shown in FIG. 1 and FIG. 7, the electrical connector 100 according to certain embodiments of the present invention is configured to electrically connect to a chip module 200 to a circuit board 300, and includes a body 1 configured to support the chip module 200 upward and a plurality of terminals 2 accommodated in the body 1.

Figure 6:
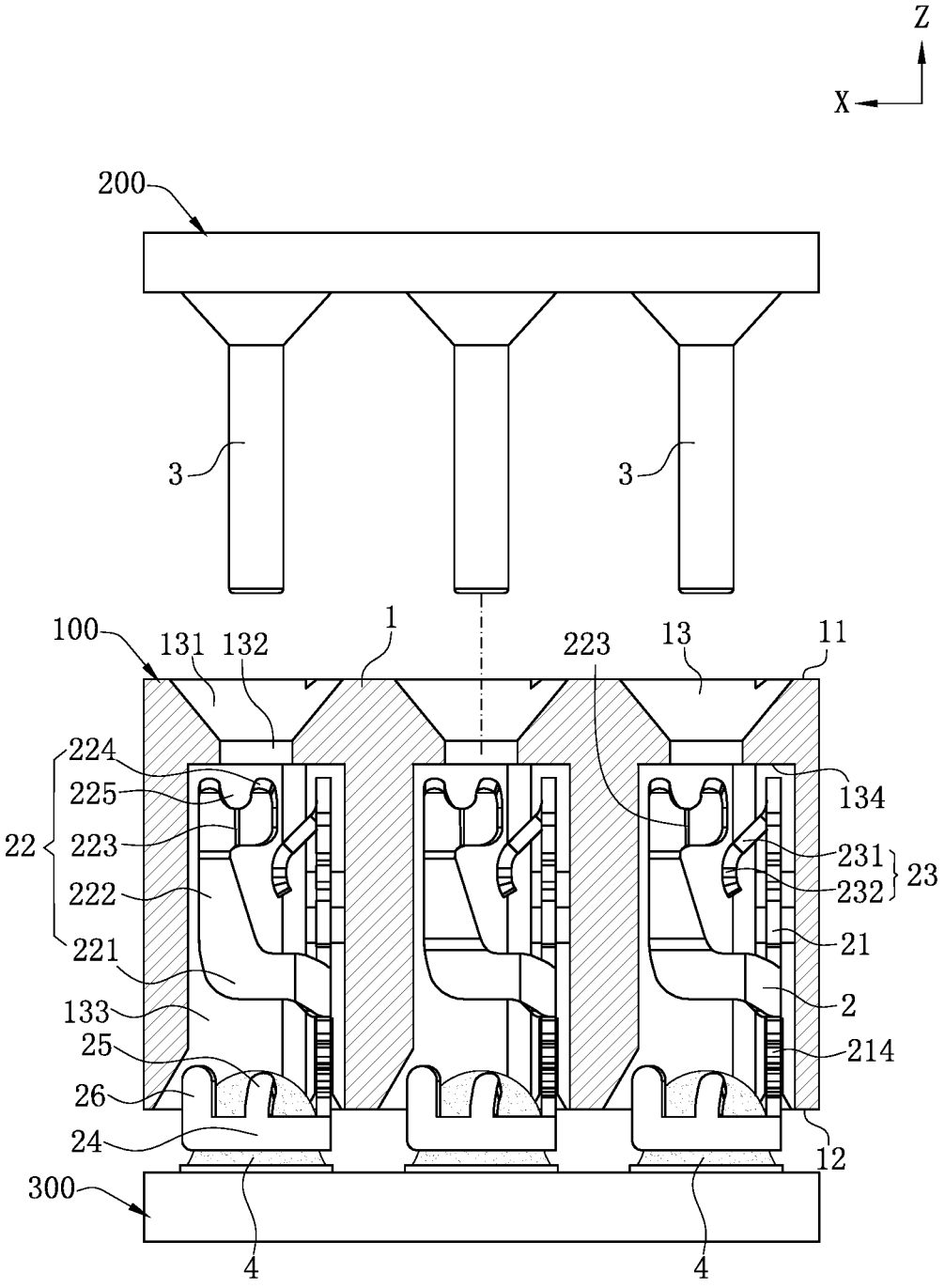
FIG. 6 is a sectional view of the electrical connector and the chip module in FIG. 5 along an A-A direction before being assembled.

As shown in FIG. 1 and FIG. 6, the chip module 200 includes a plurality of pins 3.

As shown in FIG. 1 and FIG. 6, the body 1 is an integral structure made of an insulating material. The body 1 has an upper surface 11 and a lower surface 12 opposite to each other, and a plurality of accommodating holes 13 vertically penetrate through the upper surface 11 and the lower surface 12. In other embodiments, the body 1 may include two separate pieces of structure.

As shown in FIG. 1, FIG. 6, and FIG. 7, each accommodating hole 13 includes a guiding hole 131 downward concavely provided from the upper surface 11, a connecting hole 132 extending downward from the guiding hole 131 and configured to accommodate a corresponding one of the pins 3, and a receiving hole 133 extending downward from the connecting hole 132 to run through the lower surface 12 and configured to accommodate a corresponding one of the terminals 2. The guiding hole 131 is in an inverted frustoconical shape and is configured to guide the corresponding pin 3 to move downward. The connecting hole 132 is in a cylindrical shape and has a hole size less than a hole size of the receiving hole 133, such that an upper wall of the receiving hole 133 forms a blocking wall 134, and the blocking wall 134 is parallel to the upper surface 11.

Figure 8:
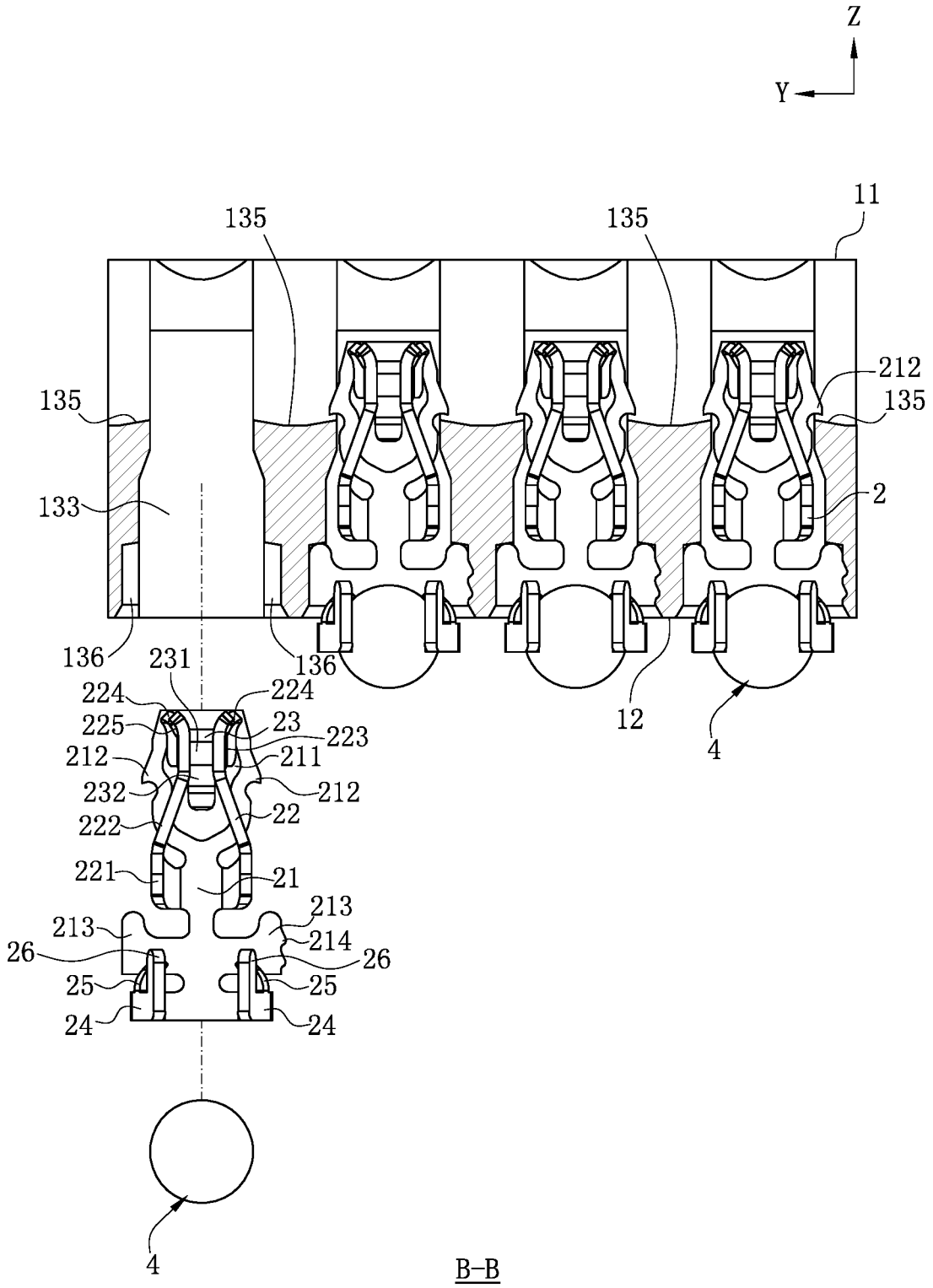
FIG. 8 is a sectional view of the electrical connector in FIG. 5 in a B-B direction.

As shown in FIG. 1 and FIG. 8, each receiving hole 133 further has two position limiting grooves 135 penetrating upward through the upper surface 11 and two grooves 136 running downward through the lower surface 12.

As shown in FIG. 1 and FIG. 8, the terminals 2 are correspondingly accommodated in the receiving holes 133.

Figure 2:
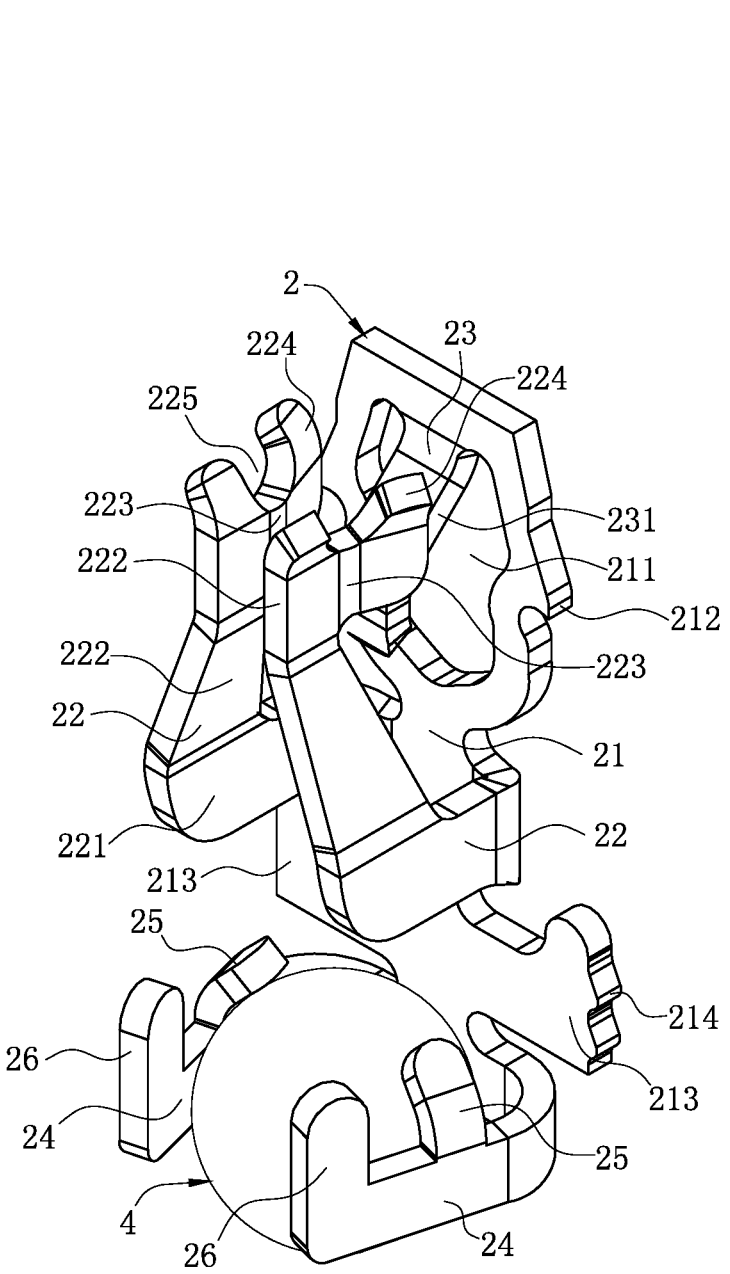
FIG. 2 is a perspective view of a terminal and a solder material in FIG. 1 after being assembled.
Figure 3:
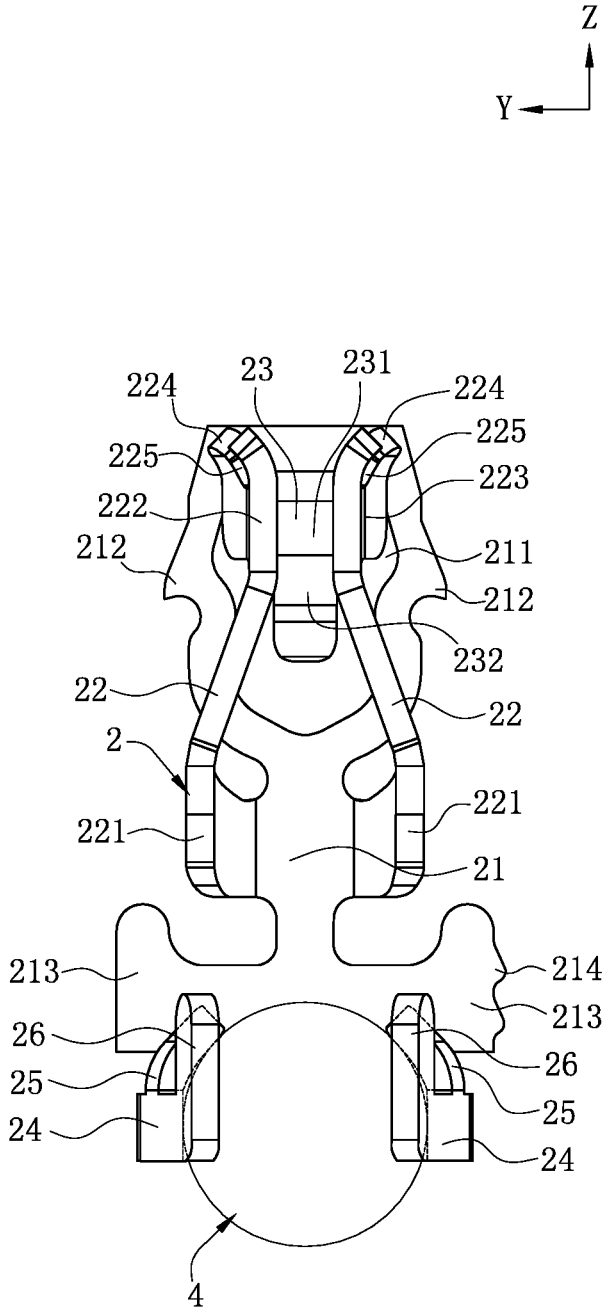
FIG. 3 is a front view of FIG. 2.
Figure 4:
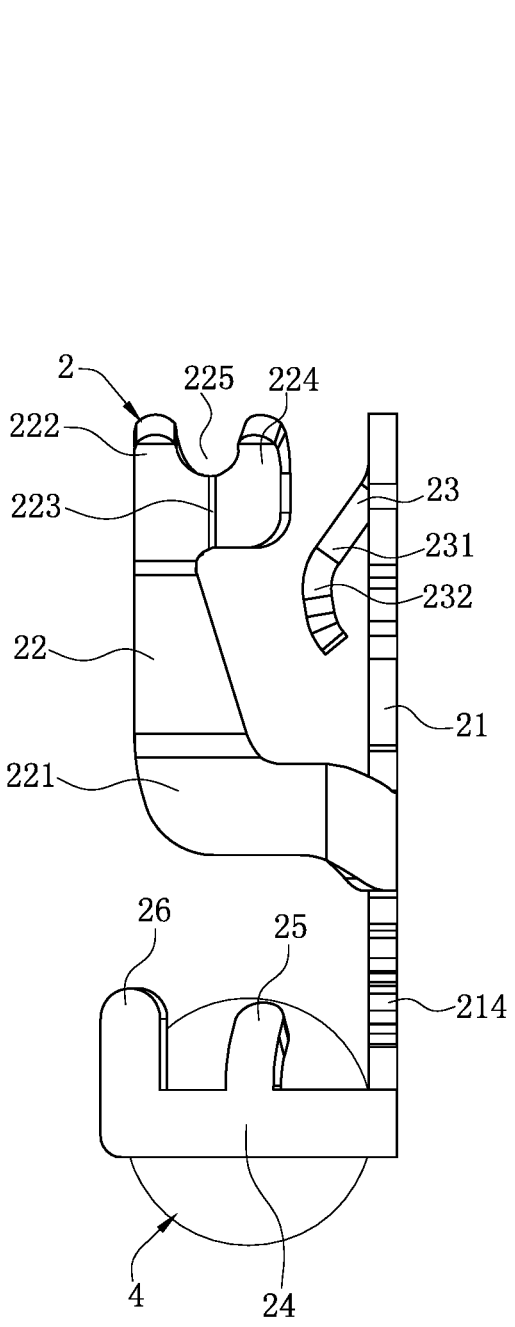
FIG. 4 is a side view of FIG. 2.

As shown in FIG. 2 to FIG. 4, each terminal 2 includes a base 21, two first arms 22, a second arm 23, two embracing arms 24, two stopping portions 25, and two position stopping portions 26.

As shown in FIG. 6, the base 21 is in a vertical plate shape, and an upper end of the base 21 is located right below the blocking wall 134.

As shown in FIG. 2 and FIG. 3, the base 21 has a through hole 211, and two hook portions 212 located at the left and right sides of the through hole 211. Two protruding portions 213 are provided to first extend from the left and right sides of the base 21 along the left-right direction Y, and then extend upward, to increase areas of the protruding portions 213 and to thereby increase strength of the protruding portions 213. As shown in FIG. 8, the hook portions 212 are correspondingly accommodated in the position limiting slots 135, and a bottom surface of each position limiting slot 135 is located right below a corresponding hook portion 212 to limit the terminal 2 from moving downward. As shown in FIG. 8, the protruding portions 213 are accommodated in the grooves 136, and an upper edge of each protruding portion 213 matches with a top surface of a corresponding groove 136 to limit the terminal 2 from moving downward. In this embodiment, a side edge of one of the two protruding portions 213 is a straight line, which matches with a side surface of the corresponding groove 136 to horizontally adjust the location of the terminal 2 in the corresponding accommodating hole 13, such that the terminal 2 is correctly located in the corresponding accommodating hole 13, preventing the terminal 2 from tilting. A side edge of the other protruding portion 213 is provided with a protrusion 214, which is in an interference fit with the other side surface of the corresponding groove 136, such that when a size of the protruding portion 213 is excessively large due to a manufacturing tolerance, the protrusion 214 may penetrate the side surface of the corresponding groove 136 to smoothly assemble the terminal 2 in the accommodating hole 12.

As shown in FIG. 2 to FIG. 4, the two first arms 22 are formed by bending forward from the left and right sides of the base 21 and then extending upward. Each first arm 22 includes an extending arm 221 bending and extending forward and upward from the base 21 (the extending arm 221 is provided by extending upward from the base 21 to give space to the protruding portions 213 when the protruding portions 213 are formed), an elastic arm 222 extending upward from an upper end of the extending arm 221, a clamping portion 223 extending backward from a rear side of the elastic arm 222, and a first guiding portion 224 extending upward from the clamping portion 223.

The extending arm 221 and the elastic arm 222 are provided in such a structure, increasing a length of the first arm 22, and the extending arm 221 and the elastic arm 222 may elastically deform together when being used. Therefore, the terminal 2 may provide a relatively good elastic force, thereby decreasing the loss of the pins 3 of the chip module 200.

Figure 5:
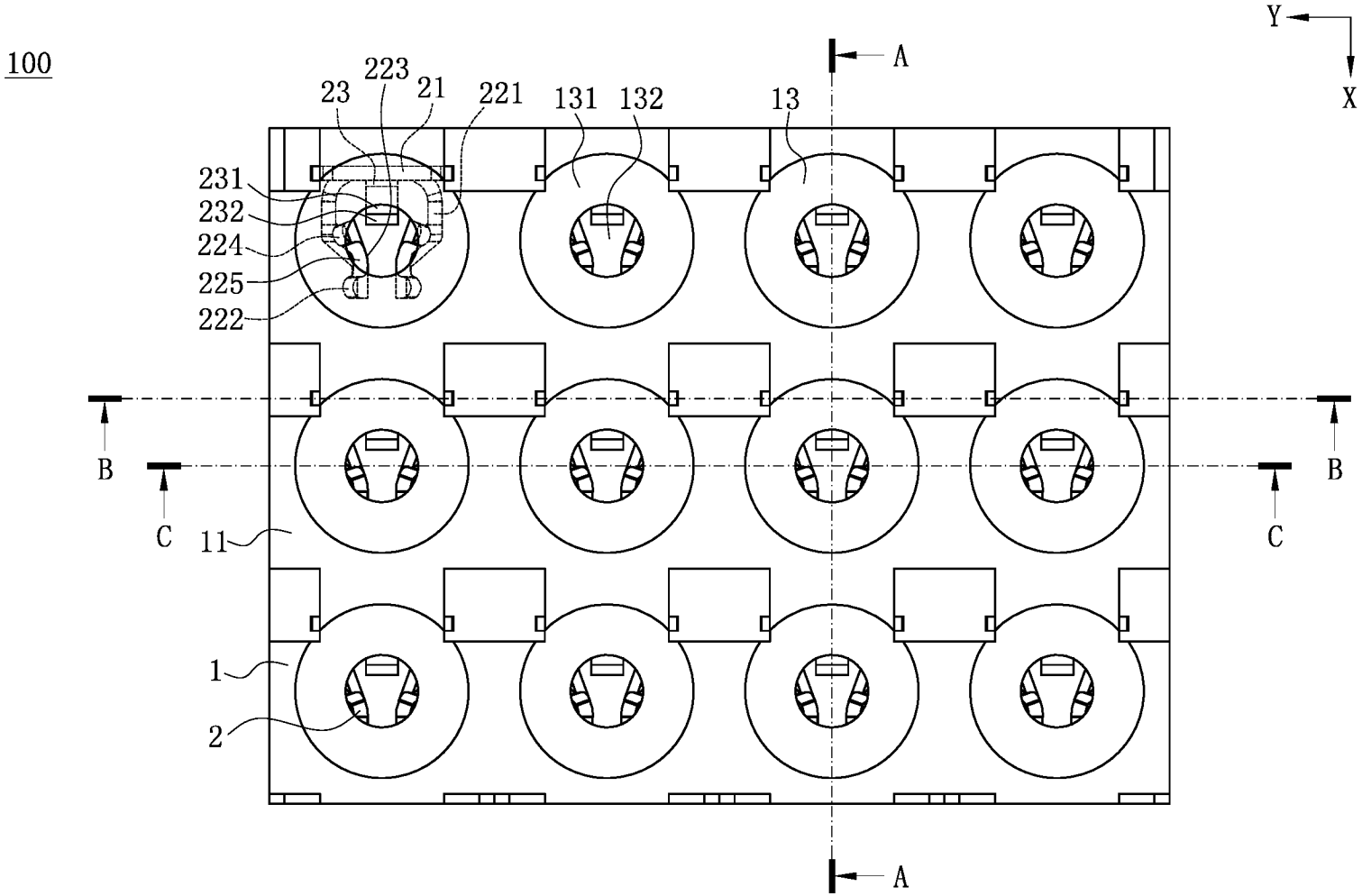
FIG. 5 is a top view of the electrical connector in FIG. 1.
Figure 9:
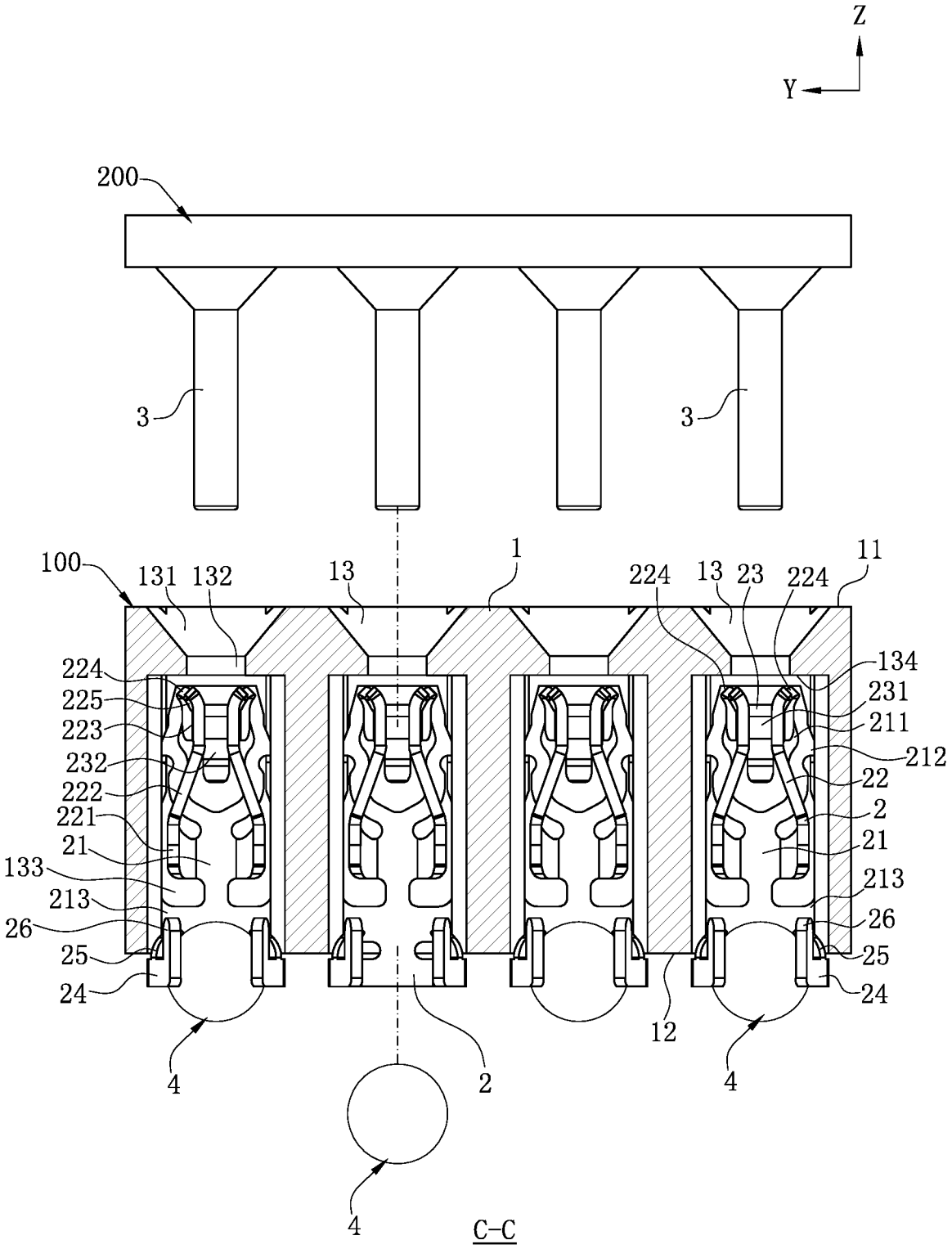
FIG. 9 is a sectional view of the electrical connector and the chip module in FIG. 5 along a C-C direction before being assembled.

As shown in FIG. 5 and FIG. 9, an upper end of the elastic arm 222 expands outward and is located right below the blocking wall 134. The clamping portion 223 is located right below the connecting hole 132, and a gap between the two clamping portions 223 gradually becomes larger in a backward direction from the front thereof. The first guiding portion 224 expands outward, and an upper end of the first guiding portion 224 is located right below the blocking wall 134, and the first guiding portion 224 is partially located right below the connecting hole 132.

As shown in FIG. 2 and FIG. 4, the first arm 22 further has an opening 225 downward concavely provided on an upper end of the first arm 22, and the opening 225 is connected to the rear side of the elastic arm 222, the upper ends of the clamping portions 223, and a front side of the first guiding portion 224 simultaneously. As shown in FIG. 5 and FIG. 6, the opening 225 is partially located right below the connecting hole 132, and a width of each opening 225 is less than a diameter of the lower ends of each pin 3.

As shown in FIG. 2 to FIG. 4, the second arm 23 includes a second guiding portion 231 bending forward and extending downward from an upper end of the through hole 211, and an abutting portion 232 extending downward from the second guiding portion 231.

As shown in FIG. 5 and FIG. 6, the second guiding portion 231 is partially located right below the connecting hole 132, and the abutting portion 232 is located right below the connecting hole 132. As shown in FIG. 6 and FIG. 7, the second guiding portion 231 is located below the first guiding portion 224, and the second guiding portion 231 and the first guiding portion 224 are configured to guide the corresponding pin 3 to be inserted downward. The abutting portion 232 is located below the clamping portions 223, and the abutting portion 232 and the two clamping portions 223 are configured to jointly clamp the corresponding pin 3 (refer to FIG. 13).

As shown in FIG. 7, in this embodiment, a contact position P1 of each clamping portion 223 and the corresponding pin 3 is higher than a contact position P2 of the abutting portion 232 and the corresponding pin 3. In other embodiments, the contact position P1 of each clamping portion 223 and the corresponding pin 3 may alternatively be lower than the contact position P2 of the abutting portion 232 and the corresponding pin 3.

As shown in FIG. 2, FIG. 3 and FIG. 6, the two embracing arms 24 are formed by bending and extending forward from the left and right sides of a lower end of the base 21, and are configured to clamp a solder 4 to solder the terminal 2 to a circuit board 300. In this embodiment, the solder 4 is a solder ball. The two stopping portions 25 are formed by bending and extending upward from middle portions of the two embracing arms 24 to be close to each other. The two stopping portions 25 are located right above the solder 4 to limit the solder 4 from moving upward. In this embodiment, the two stopping portions 25 and the two embracing arms 24 are configured to clamp the solder 4 altogether, and are located at the same side of the base 21 as the first arm 22. The two position stopping portions 26 are formed by extending upward from the front ends of the two embracing arms 24, and the two position stopping portions 26 are located in front of the two stopping portions 25. When the solder 4 is loaded upward between the two embracing arms 24, the two position stopping portions 26 match with the receiving holes 133 to prevent the two embracing arms 24 from excessively moving upward.

As shown in FIG. 1 and FIG. 8, when the electrical connector 100 is assembled, the terminals 2 are first mounted into the receiving holes 133 upward from the bottom thereof, until the hook portions 212 are accommodated in the position limiting slots 135. Meanwhile, the protruding portions 213 match with the walls of the grooves 136 to fix the terminals 2 in the receiving holes 133. As shown in FIG. 5, FIG. 6 and FIG. 9, an upper end of the first guiding portion 224 and the upper end of the base 21 are both located right below the blocking wall 134, and the clamping portions 223 and the abutting portion 232 are located right below the connecting hole 132.

Figure 10:
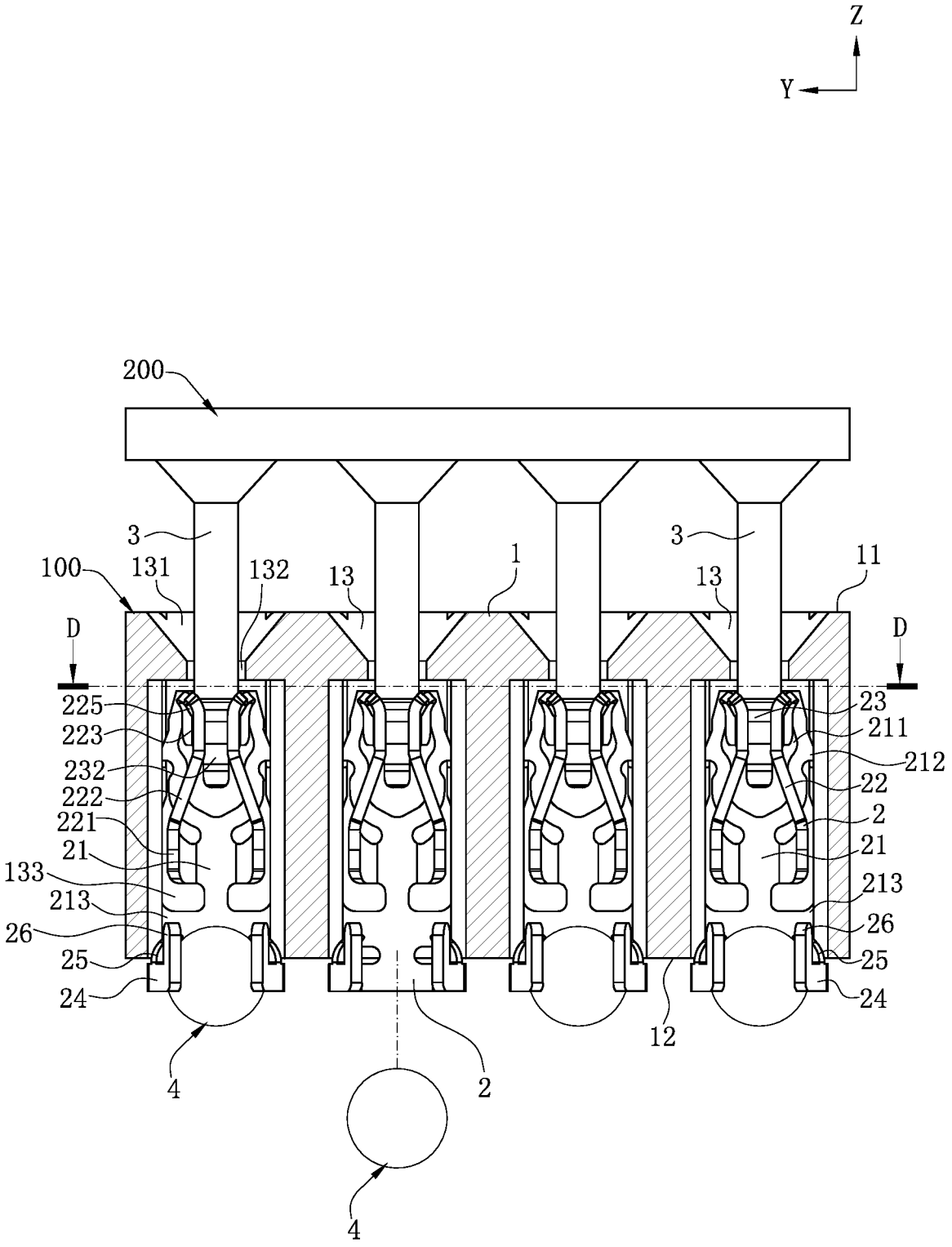
FIG. 10 is a sectional view of the terminals of the electrical connector and the pins of the chip module in FIG. 9 when being in contact with each other.
Figure 11:
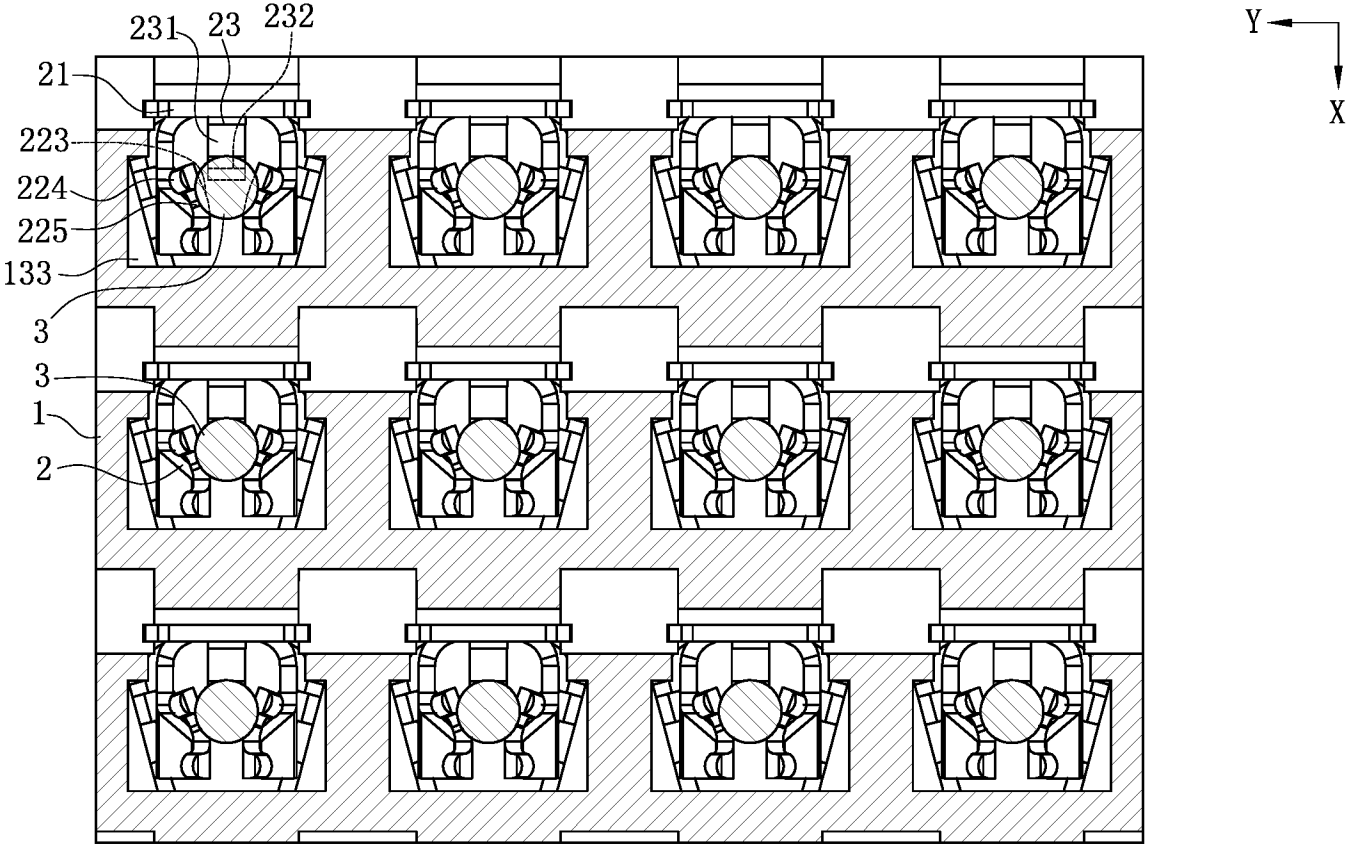
FIG. 11 is a sectional view of the electrical connector and the chip module in FIG. 10 in a D-D direction.
Figure 12:
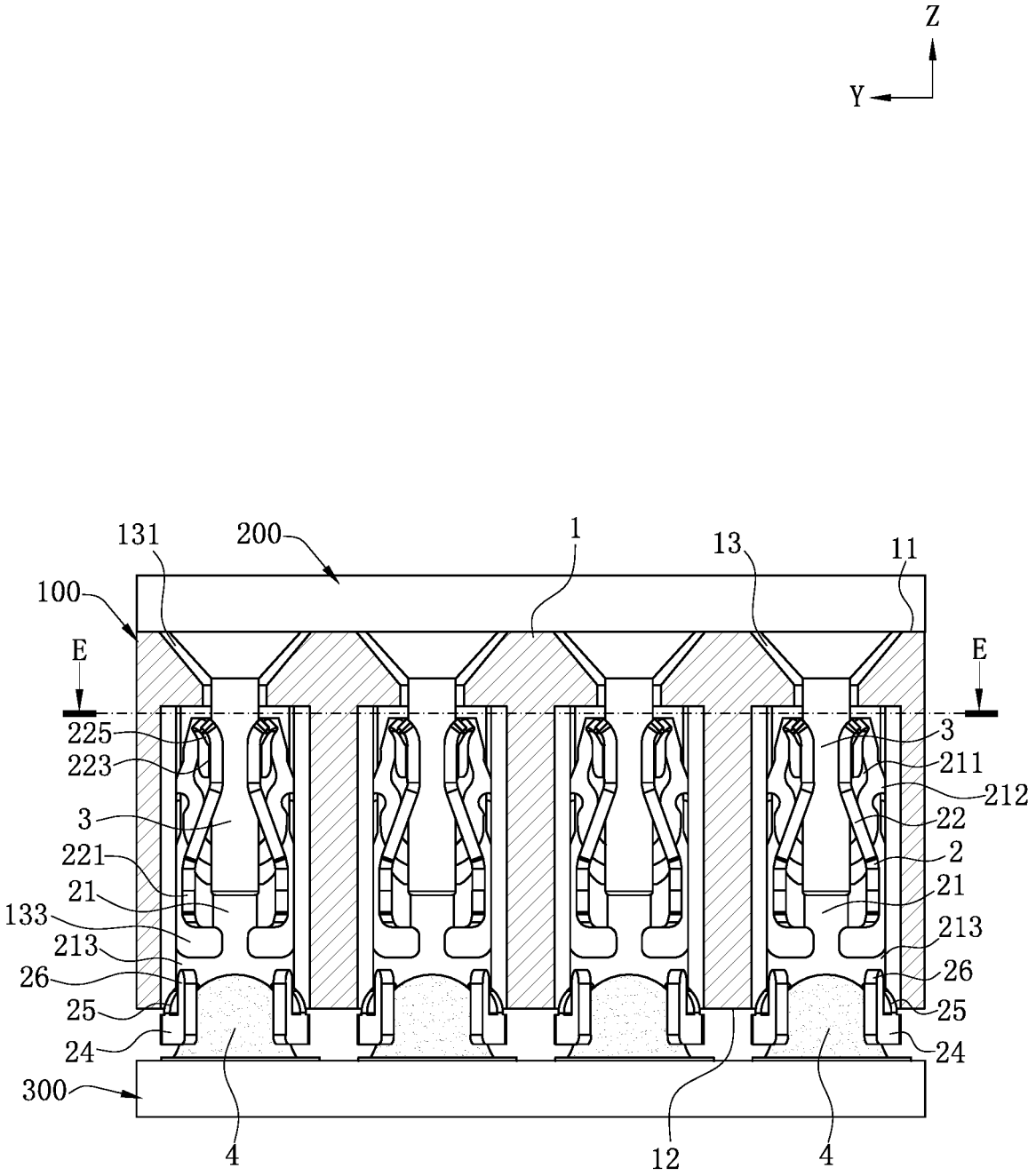
FIG. 12 is a sectional view of the electrical connector and the chip module in FIG. 9 after being assembled.
Figure 13:
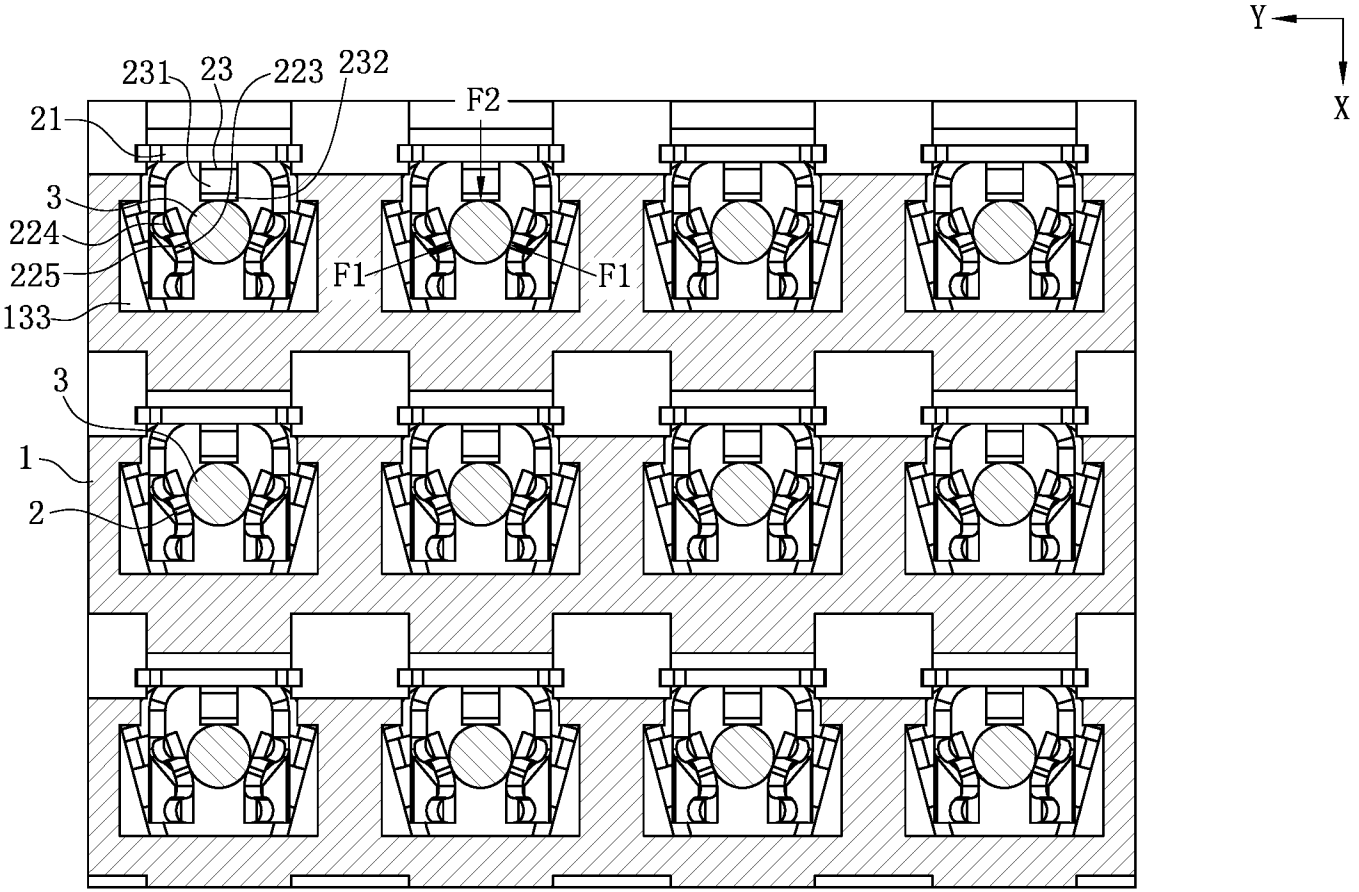
FIG. 13 is a sectional view of the electrical connector and the chip module in FIG. 12 in an E-E direction.

As shown in FIG. 9, FIG. 10 and FIG. 12, when the electrical connector 100 is used, the electrical connector 100 is first mounted on the circuit board 300, and the electrical connector 100 is fixed to the circuit board 300 through soldering by the solder 4. Then, the chip module 200 is downward mounted to the socket 100. The corresponding pin 3 is successively inserted downward through the guiding hole 131 and the connecting hole 132 and into the receiving hole 133, and the two first guiding portions 224 and the second guiding portion 231 guide the corresponding pin 3 to move downward, such that the corresponding pin 3 is first clamped between the two clamping portions 223 and then abuts the abutting portion 232 (refer to FIG. 6 and FIG. 7), until the chip module 200 downward abuts the insulation body 1 to electrically connect the chip module 200 to the circuit board 300.

To sum up, the electrical connector according to certain embodiments of the present invention have the following beneficial effects:

(1) When the corresponding pin 3 is deviated relatively to a normal insertion position when being inserted downward, since the blocking wall 134 covers the upper ends of the two first guiding portions 224 and the second arm 23 is formed by extending downwards from the base 21, the corresponding pin 3 will not collide with the free ends of the two first arms 22 and the free end of the second arm 23, thereby preventing the two first arms 22 and the second arm 23 from being damaged and facilitating the corresponding pin 3 to be inserted successfully, and ensuring stable conductive connection between the chip module 200 and the electrical connector 100.

(2) When the two clamping portions 223 and the abutting portion 232 clamp the corresponding pin 3 altogether, since a gap between the two clamping portions 223 increases gradually in a backward direction from the front thereof, an action force F1 applied by the two clamping portions 223 on the corresponding pin 3 is balanced by an action force F2 applied by the abutting portion 232 on the corresponding pin 3, ensuring stable contact between the terminal 2 and the pin 3.

(3) The opening 225 is downward concavely provided on an upper end of the first arm 22, and is connected to a front side of the first guiding portion 224, configured to facilitate forming an upper end of the elastic arm 222 to expand outward and forming the clamping portions 223 to expand backward.

(4) A width of the opening 225 is less than a diameter of a lower end of the corresponding pin 3, preventing the corresponding pin 3 from not being inserted successfully when the corresponding pin 3 is engaged in the opening 225 when being inserted, or even resulting in the first arm 22 being damaged due to collision.

(5) When the corresponding pin 3 is inserted into the receiving hole 133 through the connecting hole 132, the two clamping portions 223 and the abutting portion 232 are all located right below the connecting hole 132, such that the corresponding pin 3 is reliably in contact with the two clamping portions 223 and the abutting portion 232.

(6) The height of the contact position P1 of the clamping portions 223 and the corresponding pin 3 is different from the height of the contact position P2 of the abutting portion 232 and the corresponding pin 3, such that the corresponding pin 3 is in contact with the clamping portions 223 and the abutting portion 232 sequentially, reducing a maximum insertion force of the corresponding pin 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a chip module having a plurality of pins, the electrical connector comprising:

a body, configured to support the chip module upward, wherein the body is provided with a plurality of accommodating holes penetrating through an upper surface and a lower surface of the body, and each of the accommodating holes has a blocking wall; and a plurality of terminals, correspondingly accommodated in the accommodating holes, wherein each of the terminals comprises a base, two first arms bending forward from two opposite sides of the base and extending upward, and a second arm bending forward from the base and extending downward, the two first arms have two clamping portions and two first guiding portions extending upward from upper ends of the two clamping portions and away from each other, the blocking wall of a corresponding accommodating hole covers upper ends of the two first guiding portions, the second arm has a second guiding portion and an abutting portion extending downward from the second guiding portion, the two first guiding portions and the second guiding portion are configured to guide a corresponding pin of the pins to insert downward, and the two clamping portions and the abutting portion are configured to clamp the corresponding pin altogether.

2. The electrical connector according to claim 1, wherein a gap between the two clamping portions increases gradually in a backward direction from front thereof.

3. The electrical connector according to claim 1, wherein an upper end of each of the two first arms is concavely provided with an opening connected to a front side of a corresponding one of the two first guiding portions.

4. The electrical connector according to claim 3, wherein a width of the opening is less than a diameter of a lower end of the corresponding pin.

5. The electrical connector according to claim 1, wherein each of the accommodating holes comprises a guiding hole downward concavely provided on the upper surface of the body, a connecting hole extending downward from the guiding hole and configured to accommodate the corresponding pin, and an receiving hole extending downward from the connecting hole to penetrate through the lower surface of the body and configured to accommodate a corresponding terminal of the terminals, a hole size of the connecting hole is less than a hole size of the receiving hole, an upper wall of the receiving hole forms the blocking wall, and the two clamping portions and the abutting portion of the corresponding terminal are all located right below the connecting hole.

6. The electrical connector according to claim 1, wherein a height of a contact position of each of the clamping portions and the corresponding pin is different from a height of a contact position of the abutting portion and the corresponding pin.

7. The electrical connector according to claim 6, wherein the contact position of each of the clamping portions and the corresponding pin is higher than the contact position of the abutting portion and the corresponding pin.

8. The electrical connector according to claim 1, wherein the base has a through hole and two hook portions located at two opposite sides of the through hole, the second arm is formed by extending downward from an upper end of the through hole, the body is provided with two position limiting slots corresponding to the two hook portions, the position limiting slots penetrate upward through the upper surface of the body, and a bottom surface of each of the position limiting slots is located right below a corresponding hook portion of the hook portions to limit the corresponding terminal from moving downward.

9. The electrical connector according to claim 1, wherein two protruding portions are formed by extending from a left side and a right side of the base in a left-right direction and then extending upward, and the two protruding portions match with the corresponding accommodating hole to limit the terminal from moving.

10. The electrical connector according to claim 9, wherein a side edge of one of the two protruding portions is provided with a protrusion in interference-fit with the corresponding accommodating hole, and a side edge of the other of the two protruding portions is a straight line.

* * * * *